United States Patent [19]

Hayashi

[11] Patent Number: 4,677,942

[45] **Date of Patent: * Jul. 7, 1987**

[54] COOLING SYSTEM FOR AUTOMOTIVE ENGINE OR THE LIKE

[75] Inventor: Yoshimasa Hayashi, Kamakura, Japan

[73] Assignee: Nissan Motor Co., Ltd., Yokohama, Japan

[ * ] Notice: The portion of the term of this patent subsequent to Oct. 8, 2002 has been disclaimed.

[21] Appl. No.: 687,780

[22] Filed: Aug. 6, 1984

[30] Foreign Application Priority Data

Aug. 9, 1983 [JP] Japan ..... 58-145469
Aug. 9, 1983 [JP] Japan ..... 58-145468

[51] Int. Cl.[4] ..... F01P 3/22
[52] U.S. Cl. ..... 123/41.21; 123/41.27
[58] Field of Search ..... 123/41.2, 41.21, 41.22, 123/41.23, 41.24, 41.25, 41.26, 41.27, 41.3, 41.54

[56] References Cited

U.S. PATENT DOCUMENTS

| | | | |
|---|---|---|---|
| 1,338,722 | 5/1920 | Fekete | 123/41.03 |
| 1,376,086 | 4/1921 | Fairman | 123/41.2 |
| 1,687,679 | 10/1928 | Mallory | 123/41.27 |
| 1,787,562 | 1/1931 | Barlow | 123/41.03 |
| 1,792,520 | 2/1931 | Weinhardt | 123/41.03 |
| 1,906,072 | 4/1933 | Lumsden | 123/41.27 |
| 2,292,946 | 8/1942 | Karig | 123/41.04 |
| 2,420,436 | 2/1946 | Mallory | 123/41.02 |
| 3,981,279 | 9/1976 | Bubniak et al. | 123/41.14 |
| 4,367,699 | 1/1983 | Evans | 123/41.33 |
| 4,545,335 | 10/1985 | Hayashi | 123/41.27 |

FOREIGN PATENT DOCUMENTS

| | | | |
|---|---|---|---|
| 0059423 | 2/1982 | European Pat. Off. . | |
| 0121181 | 10/1984 | European Pat. Off. . | |
| 527342 | 5/1931 | Fed. Rep. of Germany . | |
| 736381 | 7/1940 | Fed. Rep. of Germany . | |
| 57-8312 | 1/1982 | Japan | 123/41.2 |
| 57-8313 | 1/1982 | Japan | 123/41.2 |
| 57-16219 | 1/1982 | Japan . | |
| 57-5608 | 12/1982 | Japan . | |
| 240483 | 9/1926 | United Kingdom . | |
| 419913 | 11/1934 | United Kingdom . | |
| 786437 | 11/1957 | United Kingdom . | |
| 911822 | 11/1962 | United Kingdom . | |

*Primary Examiner*—William A. Cuchlinski, Jr.
*Attorney, Agent, or Firm*—Schwartz, Jeffery, Schwaab, Mack, Blumenthal & Evans

[57] ABSTRACT

In an internal combustion engine cooling system wherein the coolant is boiled and the vapor produced condensed in a radiator in a manner that the rate of condensation under light engine load is maintained at a level sufficiently low to raise the pressure within the system and thus raise the boiling point of the coolant while under heavy load increased to the point of lowering the pressure in the system and thus lower the coolant boiling point, an arrangement is provided to reduce the heat exchange capacity of the radiator when the rate of condensation therein due to uncontrollable external influences becomes excessive. When the engine is stopped, coolant is admitted to fill the system. To purge any air or like non-condensible which finds its way into the system, liquid coolant is pumped in to overfill the system and flush same out during engine warm-up.

19 Claims, 16 Drawing Figures

COOLING SYSTEM FOR AUTOMOTIVE ENGINE OR THE LIKE

BACKGROUND OF THE INVENTION

1. Field of the Invention

The present invention relates generally to a cooling system for an internal combustion engine wherein a liquid coolant is boiled to make use of the latent heat of vaporization of the same and the vapor used as a vehicle for removing heat from the engine, and more specifically to such an engine wherein the pressure within the cooling system can be varied in order to vary the boiling point of the coolant and which includes means via which undesirable overcooling of the system due to external influences can be prevented.

2. Description of the Prior Art

In currently used "water cooled" internal combustion engines such as shown in FIG. 1 of the drawings, the engine coolant (liquid) is forcefully circulated by a water pump, through a circuit including the engine coolant jacket and an air cooled radiator. This type of system encounters the drawback that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having 1800 cc displacement (by way of example) is operated at full throttle, the cooling system is required to remove approximately 4000 Kcal/h. In order to acheive this a flow rate of 167 Liter/min (viz., $4000-60\times\frac{1}{4}$) must be produced by the water pump. This of course undesirably consumes a number of otherwise useful horsepower.

With the above type of engine cooling system, the temperature of the coolant is below boiling and maintained within a predetermined narrow temperature range (usually 80 to 90 degrees) irrespective of the load and/or mode of operation of the engine, despite the fact that it is advantageous from the point of fuel economy to raise the temperature of the engine during low-medium load "urban" cruising, to increase the thermal efficiency of the engine, and reduce same during high speed and/or high load (full throttle) modes of operation for engine protection and charging efficiency.

One arrangement which has attempted to overcome the above mentioned problems is disclosed in Japanese Patent Application First Provisional Publication No. Sho 58-5449. This arrangement senses the temperature of the combustion chamber walls and controls an electrically powered water pump in accordance therewith. However, as in the arrangement disclosed hereinbefore, still a large volume of water or like coolant is required and during high load operation the electric pump is continuously energized consuming similar large amounts of energy.

Another arrangement via which the temperature of the engine may be varied in response to load is disclosed in U.S. Pat. No. 2,420,436 issued on May 1947 in the name of Mallory. This document discloses an arrangement wherein the volume of water in the radiator system is increased and decreased in response to engine temperature and load. However, with this arrangement only the water level in the radiator is varied while the water jacket, formed in the cylinder block and cylinder head, remains full under the influence of a water circulation pump. Accordingly, this arrangement has suffered from the drawback that a power consuming water circulation pump is required, the temperature by which the coolant can be increased is limited by the fact that the water is prevented from boiling and in that the notable mass of water increases the weight and flows engine warm-up.

FIG. 2 shows an arrangement disclosed in Japanese Patent Application Second Provisional Publication No. Sho 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement has suffered from the drawbacks that the radiator, depending on its position with respect to the engine proper tends to be at least partially filled with liquid coolant. This greatly reduces the surface area via which the gaseous coolant (for example steam) can effectively release its latent heat of vaporization and accordingly condense and thus has lacked any notable improvement in cooling efficiency.

Further, with this system the pressure is maintained at atmospheric level in order to maintain the boiling point of the coolant constant and thus lacks any response to changes in engine load and speed. In order to maintain the pressure within the coolant jacket and radiator at atmospheric level, a gas permeable water shedding filter 5 is arranged as shown, to permit the entry of air into and out of the system. However, this filter permits gaseous coolant to gradually escape from the system, inducing the need for frequent topping up of the coolant level.

A further problem with this arrangement is that some of the air, which is sucked into the cooling system as the engine cools, tends to dissolve in the water, whereby upon start up of the engine, the dissolved air tends to form small bubbles in the radiator which adhere to the walls thereof forming an insulating layer. The undisolved air tends to collect in the upper section of the radiator and inhibit the convention-like circulation of the vapor from the cylinder block to the radiator. This of course further deteriorates the performance of the device.

European Patent Application Provisional Publication No. 0 059 423 published on Sept. 8, 1982 discloses another arrangement wherein, liquid coolant in the coolant jacket of the engine, is not circulated therein and permitted to absorb heat to the point of boiling. The gaseous coolant thus generated is adiabatically compressed in a compressor so as to raise the temperature and pressure thereof and introduced into a heat exchanger. After condensing, the coolant is temporarily stored in a reservoir and recycled back into the coolant jacket via a flow control valve.

This arrangement has suffered from the drawbacks that the pressure within the engine coolant jacket is maintained essentially constant thus rendering and load responsive temperature control impossible, and further in that air tends to leak into the system upon cooling thereof. This air tends to be forced by the compressor along with the gaseous coolant into the radiator. Due to the difference in specific gravity, the air tends to rise in the hot environment while the coolant which has condensed moves downwardly. The air, due to this inherent tendency to rise, forms large bubbles of air which cause a kind of "embolism" in the radiator and badly impair the heat exchange ability thereof.

U.S. Pat. No. 4,367,699 issued on Jan 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the "dry" gaseous coolant (steam for example) is condensed in a fan cooled radiator 8. The temperature of the radiator is controlled by selective energizations of the fan 9 to maintain a rate of condensation wherein sufficient to maintain a liquid seal at the bottom of the device. Condensate discharged from the radiator via the above mentioned liquid seal is collected in a small reservoir-like arrangement 10 and pumped back up to the separation tank via a small pump 11.

This arrangement, while providing an arrangement via which air can be initially purged from the system tends to, due to the nature of the arrangement which permits said initial non-condensible matter to be forced out of the system, suffers from rapid loss of coolant when operated at relatively high altitudes. Further, once the engine cools air is relatively freely admitted back into the system. Moreover, with this system it is impossible to reduce the pressure within the system below atmospheric so as to lower the boiling point of the coolant as under such conditions air is readily inducted into the system. The provision of the separation tank 6 also renders engine layout difficult.

Japanese Patent Application First Provisional Publication No. Sho. 56-32026 (see FIG. 4 of the drawings) discloses an arrangement wherein the structure defining the cylinder head and cylinder liners are covered in a porous layer of ceramic material 12 and coolant sprayed into the cylinder block from shower-like arrangements 13 located above the cylinder heads 14. The interior of the coolant jacket defined within the engine proper is essentially filled with gaseous coolant during engine operation during which liquid coolant sprayed onto the ceramic layers 12. However, this arrangement has proved totally unsatisfactory in that upon boiling of the liquid coolant absorbed into the ceramic layers the vapor thus produced escaping into the coolant jacket inhibits the penetration of liquid coolant into the layers whereby rapid overheat and thermal damage of the ceramic layers 12 and/or engine soon results. Further, this arrangement is plagued with air contamination and blockages in the radiator similar to the compressor equipped arrangement discussed above.

Another air purge arrangement for a so called "vapor cooled" type engine of the nature disclosed hereinabove in connection with U.S. Pat. No. 4,367,699, is found in U.S. Pat. No. 2,229,946 issued in Aug. 11, 1942 in the name of Karig. This arrangement includes a heat sensitive bulb which is subject to the interior of the condensor or radiator. The bulb contains a volatile liquid and controls the opening and closing of a diaphragm valve. With this arrangement, upon a sufficiently high temperature prevailing in the condensor, the diaphram valve closes a vent port through which air and the like is discharged during initial warm-up. However, this arrangement aims at maintaining a uniform temperature regardless of variations in the conditions to which the engine is exposed and accordingly lacks any ability to vary the engine temperature in response to changes in engine speed and engine load and in no way seeks to induce conditions which minimize the tendancy for contaminating air to leak back into the system when it cools down after operation.

SUMMARY OF THE INVENTION

It is an object of the present invention to provide a cooling system for an internal combustion engine wherein a liquid coolant is boiled and the vapor used as heat transfer medium, which can be operated in a manner as to control the pressure within the system to levels appropriate for the given mode of engine operation and which further obviates overcooling of the system due to external influences.

It is a further object to provide a system which minimizes the tendancy for air or the like contaminating non-condensible matter to the inducted into the system, and which further enables the purging of such matter during either or both of cooling and warming-up of the same.

In brief, the above mentioned objects are fullfilled by embodiments of the present invention which take the form of an internal combustion engine cooling system wherein the coolant is boiled and the vapor produced condensed in a radiator in a manner that the rate of condensation, under light engine load, is maintained at a level sufficiently low to raise the pressure within the system and thus raise the boiling point of the coolant while, under heavy load, increased to the point of lowering the pressure in the system and thus lower the coolant boiling point; and wherein an arrangement is provided to (a) reduce the heat exchange capacity of the radiator when the rate of condensation therein, due to uncontrollable external influences, becomes excessive; (b) fill the system with liquid coolant when the engine is stopped, and (c) purge any air or like non-condensible which finds its way in, by pumping liquid coolant in to overfill the system and flush same out during engine warm-up.

The present invention in its broadest sense, takes the form of a method of cooling a device which features boiling a liquid coolant in a coolant jacket, condensing the vapor produced in the boiling step, in a radiator, and reducing the heat exchange capacity of the radiator in the event that the rate of condensation exceeds a predetermined maximum value.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Before proceeding with the description of the embodiments of the present invention, it is deemed appropriate to discuss the concept on which the present invention is based.

Figure 1:
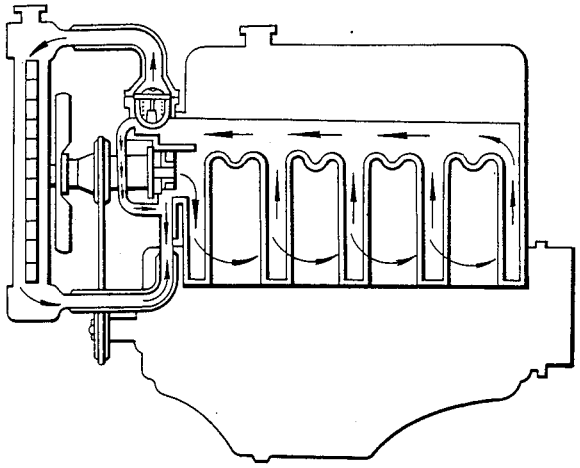
FIG.1 (PRIOR ART)
FIG. 1 is a sectional side elevation of a prior art cooling system discussed in the opening paragraphs of the instant disclosure wherein liquid coolant is continously circulated between the engine coolant jacket and a radiator.
Figure 4:
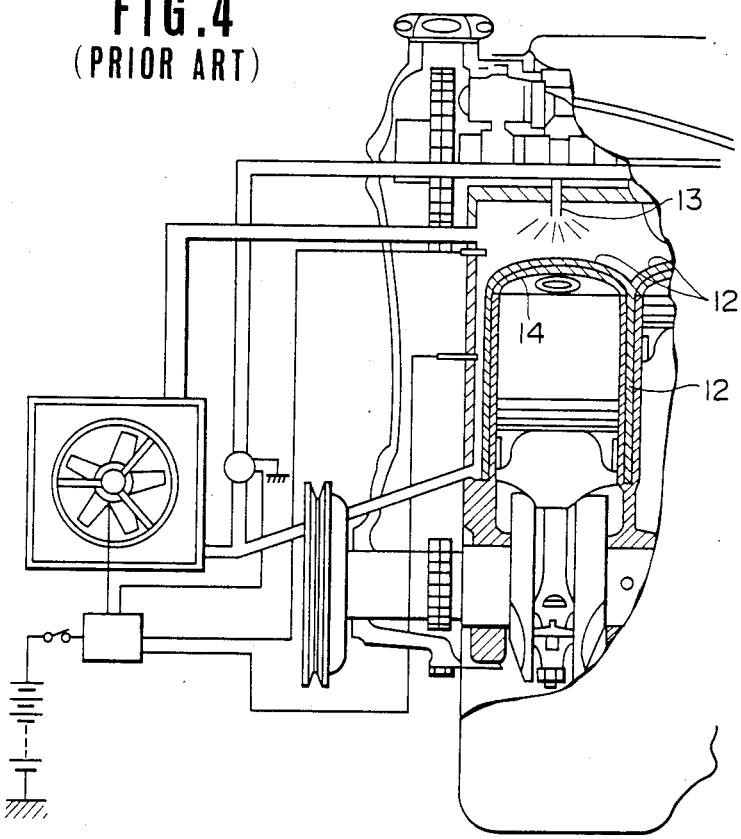
FIG.4 (PRIOR ART)
FIG. 4 is a partially sectioned view of a fourth prior art arrangement discussed briefly in the opening paragraphs of the instant disclosure.
Figure 2:
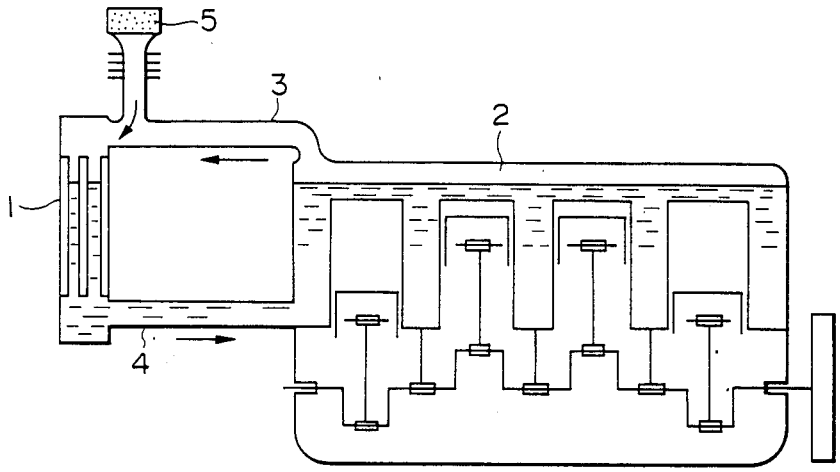
FIG.2 (PRIOR ART)
FIG. 2 is a schematic side elevation of a second prior art cooling system discussed in the opening paragraphs of the instant disclosure.
Figure 3:
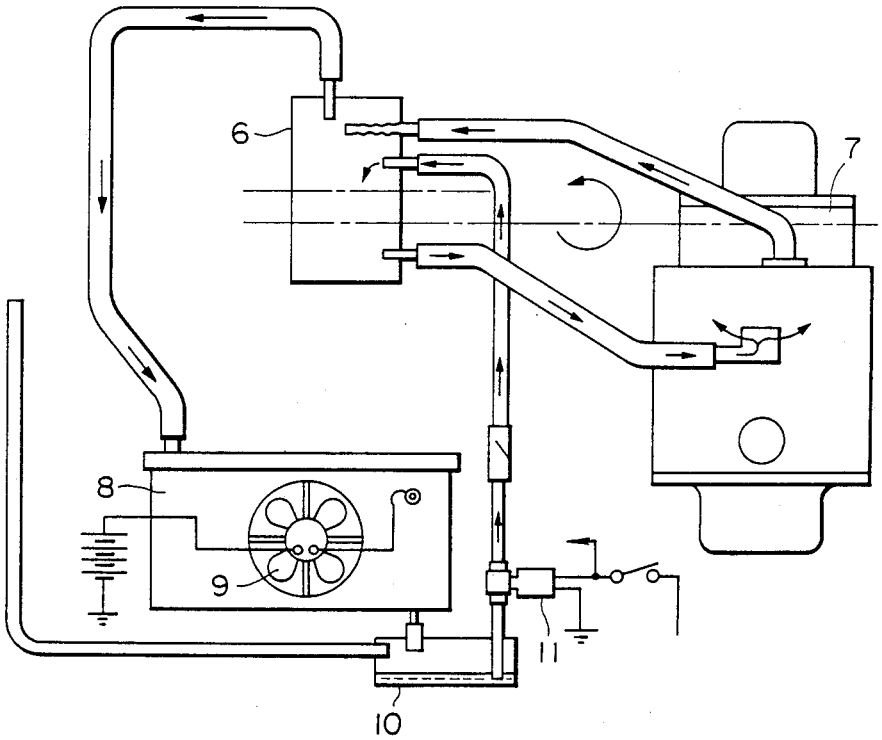
FIG.3 (PRIOR ART)
FIG. 3 is a schematic view of a third prior art arrangement.
Figure 5:
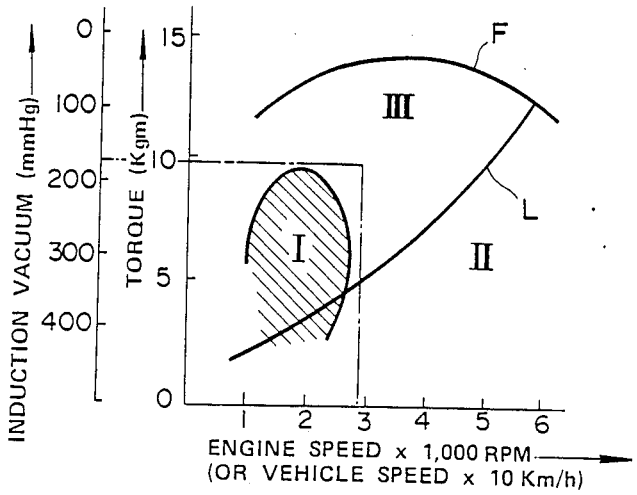
FIG. 5 is a graph showing, in terms of load (torque or induction pressure) and engine speed, the various load zones encountered by internal combustion engines.

FIG. 5 graphically shows in terms of engine torque and engine speed the various load "zones" which are encountered by an automotive vehicle engine. In this graph, the the curve F denotes full throttle torque characteristics, trace L denotes the resistance encountered when a vehicle is running on a level surface, and zones I, II and III denote respectively "urban cruising", "high speed cruising" and "high load operation" (such as hillclimbing, towing etc.).

A suitable coolant temperature for zone I is approximately 110° C. while 90°-80° C. for zones II and III. The high temperature during "urban cruising" of course promotes improved fuel economy while the lower temperatures promote improved charging efficiency while simultaneously removing sufficient heat from the engine and associated structure to prevent engine knocking and/or engine damage in the other zones. For operational modes which fall between the aforementioned first, second and third zones, it is possible to maintain the engine coolant temperature at approximately 100° C.

Figure 6:
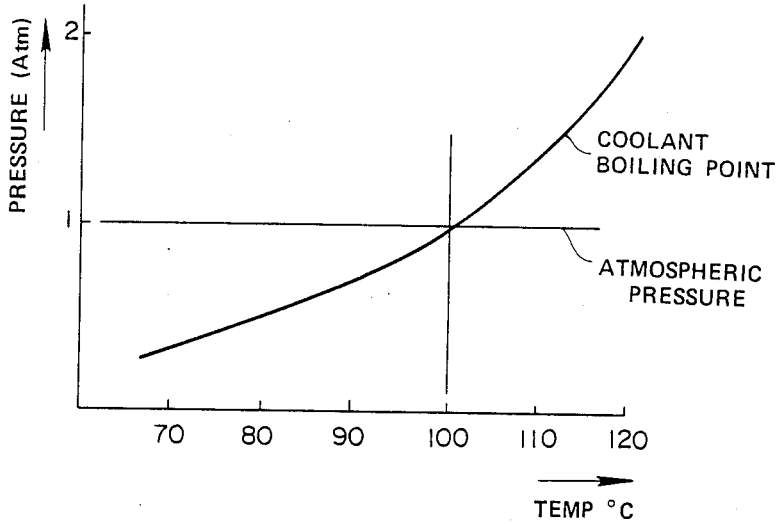
FIG. 6 is a graph showing, in terms of pressure and temperature, the change of boiling point which occurs which change of pressure within the cooling system according to the present invention.

With the present invention, in order to control the temperature of the engine, advantage is taken of the fact that with a cooling system wherein the coolant is boiled and the vapor used a heat transfer medium, the amount of coolant actually circulated between the coolant jacket and the radiator is very small, the amount of heat removed from the engine per unit volume of coolant is very high, and upon boiling, the pressure prevailing within the coolant jacket and consequently the boiling point of the coolant rises if the system employed is closed. Thus, by circulating only a limited amount of cooling air over the radiator, it is possible reduce the rate of condensation therein and cause the pressure within the cooling system to rise above atmospheric and thus induce the situation, as shown in FIG. 6, wherein the engine coolant boils at temperatures above 100° C. for example at approximately 119° C. (corresponding to a pressure of approximately 1.9 Atmospheres).

On the other hand, during high speed cruising, it is further possible by increasing the flow of cooling air passing over the radiator, to increase the rate of condensation within the radiator to a level which reduces the pressure prevailing in the cooling system below atmospheric and thus induce the situation wherein the coolant boils at temperatures in the order of 80° to 90° C.

However, under certain circumstances, such as prolonged downhill coasting or during extremely cold weather, it is possible that the rate of condensation in the radiator becomes excessive, lowering the boiling point of the coolant below that desired under such conditions and inducing a negative pressure sufficient to collapse the hosing and/or crush some of the engine apparatus. Accordingly, the present invention features an arrangement for reducing the heat exchange capacity of the radiator and thus limit the amount of heat which may be removed from the engine. In the embodiments of the present invention, this reduction in heat exchange capacity is achieved by partially filling the radiator with liquid coolant. This reduces the surface area available for the vapor to realease its latent heat of vaporization and thus the amount of heat which may be released from the system. It should be noted that the present invention is not specifically limited to this particular technique and encompasses other methods such as the provision of shields, louvers etc.

Figure 7:
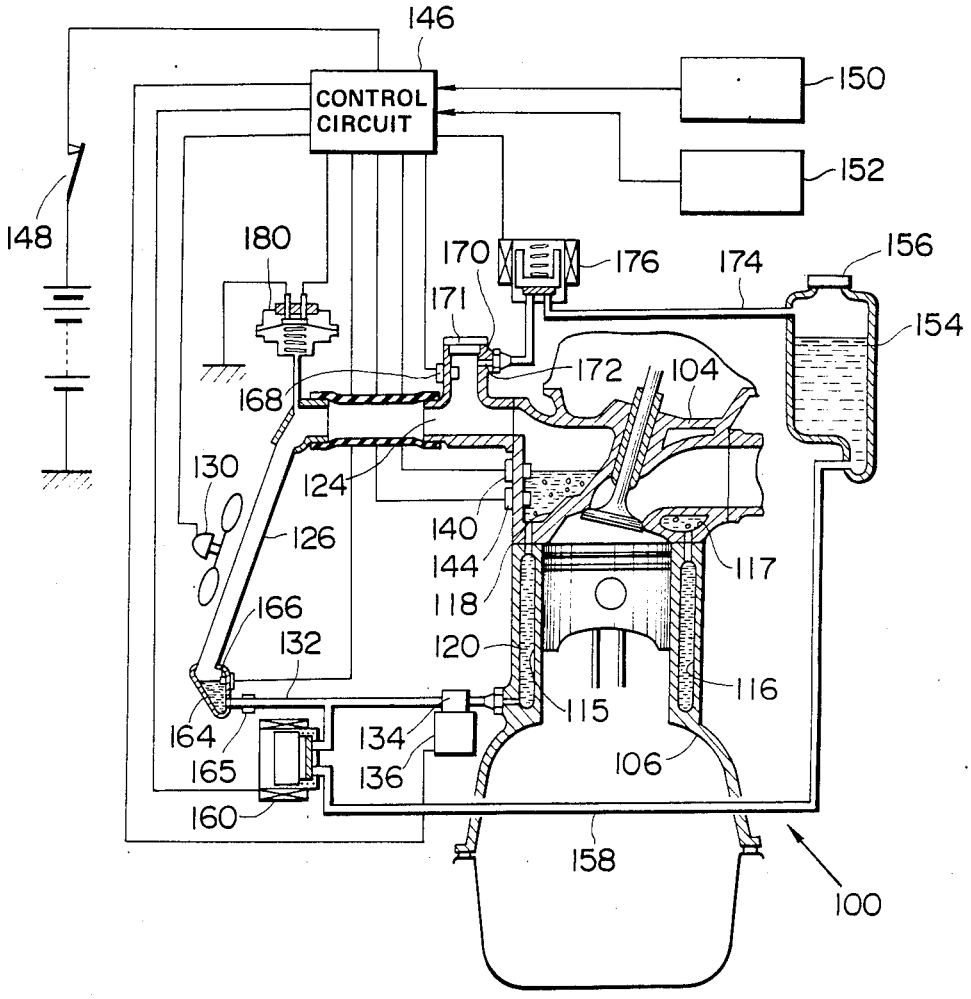
FIGS. 7 to 9 show an engine system incorporating a first embodiment of the present invention.
Figure 8:
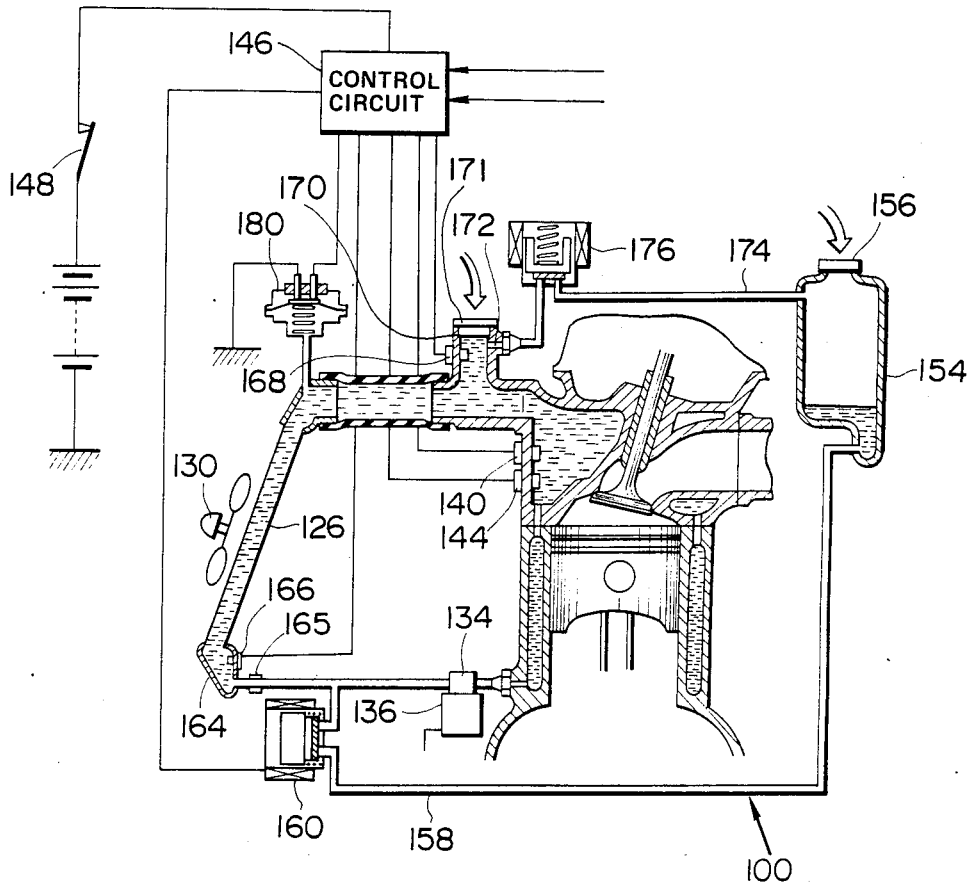
Figure 9:
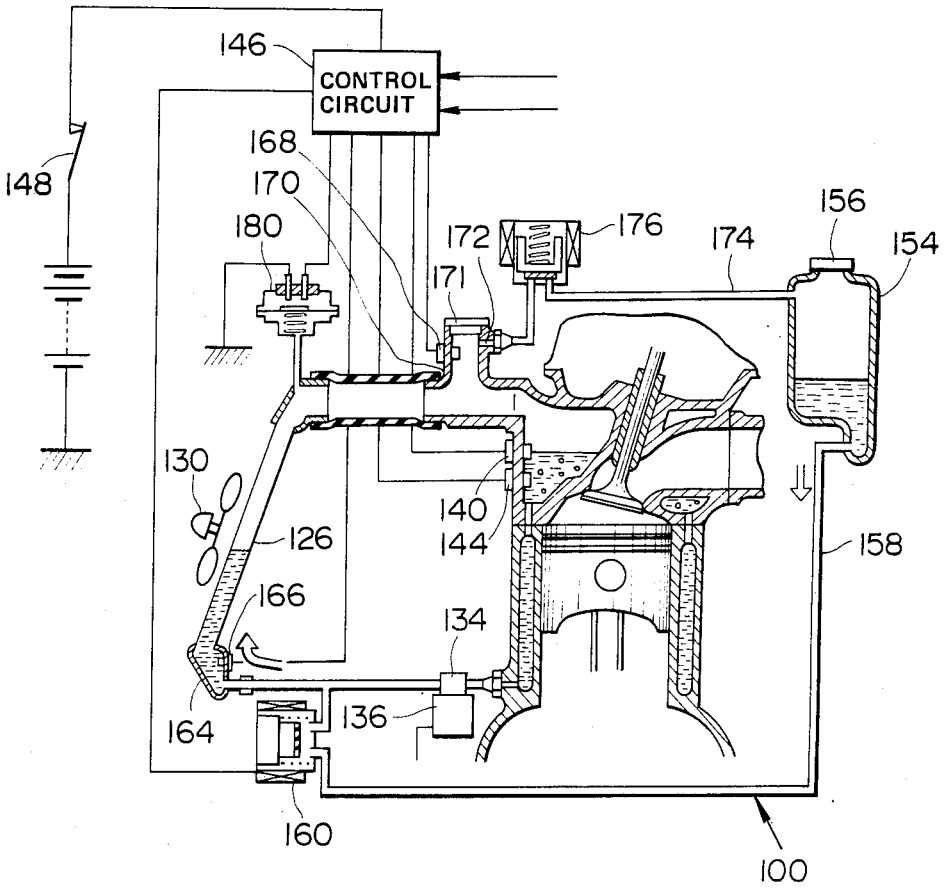

FIGS. 7 to 9 show an engine system incorporating a first embodiment of the present invention. In this arrangement, an internal combustion engine 100 includes a cylinder block 106 on which a cylinder head 104 is detachably secured. The cylinder head and cylinder block include suitable cavities 115–118 which define a coolant jacket 120 about the heated portions of the cylinder head and block.

Fluidly communicating with a vapor discharge port 124 of the cylinder head 104 is a radiator or heat exchanger 126. It should be noted that the interior of this radiator 126 is maintained essentially empty of liquid coolant during normal engine operation so as to maximize the surface area available for condensing coolant vapor (via heat exchange with the ambient atmosphere) and that the cooling system as a whole (viz., coolant jacket, radiator etc.) is hermetically sealed when the engine is warmed-up and running.

If deemed advantageous a mesh screen or like separator (not shown) can be disposed in the vapor discharge port of the cylinder head so as to minimize the transfer of liquid coolant which tends to froth during boiling, to the radiator 126.

Located suitably adjacent the radiator 126 is a electrically driven fan 130. Disposed in a coolant return conduit 132 is a return pump 134. In this embodiment, the pump is driven by an electric motor 136 and arranged to introduce the cooled discharged therefrom, into the lowermost portion of the coolant jacked 120.

In order to control the level of coolant in the coolant jacket, a level sensor 140 is disposed as shown. It will be noted that this sensor is located at a level higher than that of the combustion chambers, exhaust ports and valves (structure subject to high heat flux) so as to maintain same securely immersed in coolant and therefore attenuate engine knocking and the like due to the formation of localized zones of abnormally high temperature or "hot spots".

Located below the level sensor 140 so as to be immersed in the liquid coolant is a temperature sensor 144. The output of the level sensor 140 and the temperature sensor 144 are fed to a control circuit 146 or modulator which is suitably connected with a source of EMF upon closure of a switch 148. This switch of course may advantageously be arranged to be simultaneously closed with the ignition switch of the engine (not shown).

The control circuit 146 further receives an input from the engine distributor 150 (or like device) indicative of engine speed and an input from a load sensing device 152 such as a throttle valve position sensor. It will be noted that as an alternative to throttle position, the output of an air flow meter or an induction vacuum sensor may used to indicate load.

A coolant reservoir 154 is located beside the engine proper as shown. An air permeable cap 156 is used to close the reservoir in a manner that atmospheric pressure continuously prevails therein.

The reservoir 154 fluidly communicates with the engine coolant jacket 120 via a supply conduit 158 and an electromagnetic valve 160. This valve is closed when energized. As shown, the supply conduit 158 is arranged to communicate with the return conduit 132 which leads from a small collection tank or reservoir 164 provided at the bottom of the radiator 126, to the pump 134. A flow restriction 165 is disposed between the pump 134 and the reservoir 164 at a location intermediate of said reservoir 164 and the location where supply conduit 158 merges with the return conduit 132. A second level sensor 166 is disposed in the collection tank or reservoir 164.

A third coolant level sensor 168 is disposed in a riser-like portion 170 of the cylinder head 104. This sensor 168 is located immediately below a cap 171 which hermetically closes the riser 170. Located immediately adjacent and/or slighty above the third level sensor 168 is a "purge" port 172. This port, as shown, communicates with the reservoir 154 via an overflow conduit 174. A normally closed second electromagnetic valve 176 is disposed in the overflow conduit 174. This valve is opened when energized.

In this embodiment a pressure responsive diaphragm operated switch 180 is arranged to communicate with the upper section of the radiator 126. This switch is arranged to be normally closed and open only upon a negative pressure in excess of a predetermined low level prevailing in the system.

Prior to use the cooling system is filled to the brim with coolant (for example water or a mixture of water and antifreeze or the like) and the cap 171 securely set in place to seal the system (see FIG. 8). A suitable quantity of additional coolant is also poured into the reservoir 154. At this time the electromagnetic valve 160 should be temporarily energized or a similar precautions taken to facilitate the filling of an appropriate amount of coolant into the system.

When the engine is started as the system is completely filled with coolant, very little heat can be removed from the engine and the coolant quickly warms. Before reaching a predetermined temperature (for example 35° C.), any air in the system, such as that disolved in the coolant per se, tends to be forced out of solution by the heating this air rises to collect in the riser portion 170. At this time, if the level of coolant falls below that of the level sensor 168, the control circuit energize the electromagnetic valve 176 and the pump 134 and de-energizes valve 160. This energization may be continued for a predetermined short period of time (e.g. three or four seconds) after the level sensor 168 indicates the level has risen thereto. This procedure opens valve 160, and opens the overflow conduit 174 (via opening of the third valve 176). Accordingly, the pump 134 draws coolant from the reservoir 154 via conduit 158 and forces same into the system overfilling same. The excess coolant displaces the air or other non-condensible matter out through the overflow conduit 174 as it overflows back to the reservoir 154. Upon the previously mentioned predetermined temperature being exceeded, this "purge" mode is terminated and the valve 176 and pump 134 are de-energized.

Subsequently, the coolant temperature continues to rise and begins generating vapor pressure within the system. This pressure displaces coolant back out through valve 160 (still de-energized) to the reservoir 154 until the first level sensor 140 is uncovered. This induces the energization of the pump 134 which inducts coolant from the radiator 126 and discharges same into the cylinder block 106. This tends to empty the radiator 126 while maintaining the level of the coolant within the cylinder block at that of the first level sensor 140. This procedure is continued until the level of coolant in the radiator 126 falls to that of the second level sensor 166, whereupon the valve 160 is energized and system placed in a "closed" condition (see FIG. 7).

In order to control the temperature within the coolant jacket the control circuit 146 selectively energizes the motor of the fan 130 in a manner to induce a rate of condensation in the radiator which controls the pressure prevailing in the cooling system to a level whereat the coolant boils at a temperature suited to the particular load and/or engine speed conditions of the engine.

However, should the rate of condensation within the radiator increase due to external influences and the pressure within the system fall below the predetermined low level, the pressure responsive switch 180 opens and the electromagnetic valve is de-energized to permit the coolant stored in the reservoir 154 to be inducted into the system under the influence of the negative pressure. As the supply conduit 158 communicates with the return conduit 132 upstream of the pump 134, the coolant from the reservoir 154 tends to flow through the flow restriction 165 to gradually enter the radiator 126 (see FIG. 9). Upon, the engine entering a low load mode of operation, the temperature of the coolant will tend to rise and produce sufficient pressure within the system to displace the liquid coolant in the radiator 126 back to the reservoir 154. Upon the second level 166 sensor disposed in the reservoir 164 sensing the level having fallen thereto, the valve 160 is closed and the system re-enters fully closed operation again.

Upon stoppage of the engine 100, valve 160 is de-energized and, as the vapor pressure within the radiator and cylinder head falls due to the cooling of the engine and the condensation of the vapor therein, coolant flows into the system from the reservoir 154 via the valve 160 under the influence of atmospheric pressure acting on the surface of the coolant in the reservoir until the system is filled. It will be noted that if desired the de-energization of valve 160 and/or the whole control circuit 146, can be delayed after engine stoppage to allow for the pressure in the system to fall to atmospheric level.

Filling of the cooling system in this manner obviates any tendancy for sub-atmospheric conditions to prevail and hence for any air to be inducted.

Upon the engine being started again, if the temperature has fallen below 35° C. (by way of example only) the previously disclosed "purge" mode will be initiated should the third level sensor indicate that the riser portion is not completely filled with coolant.

Figure 10:
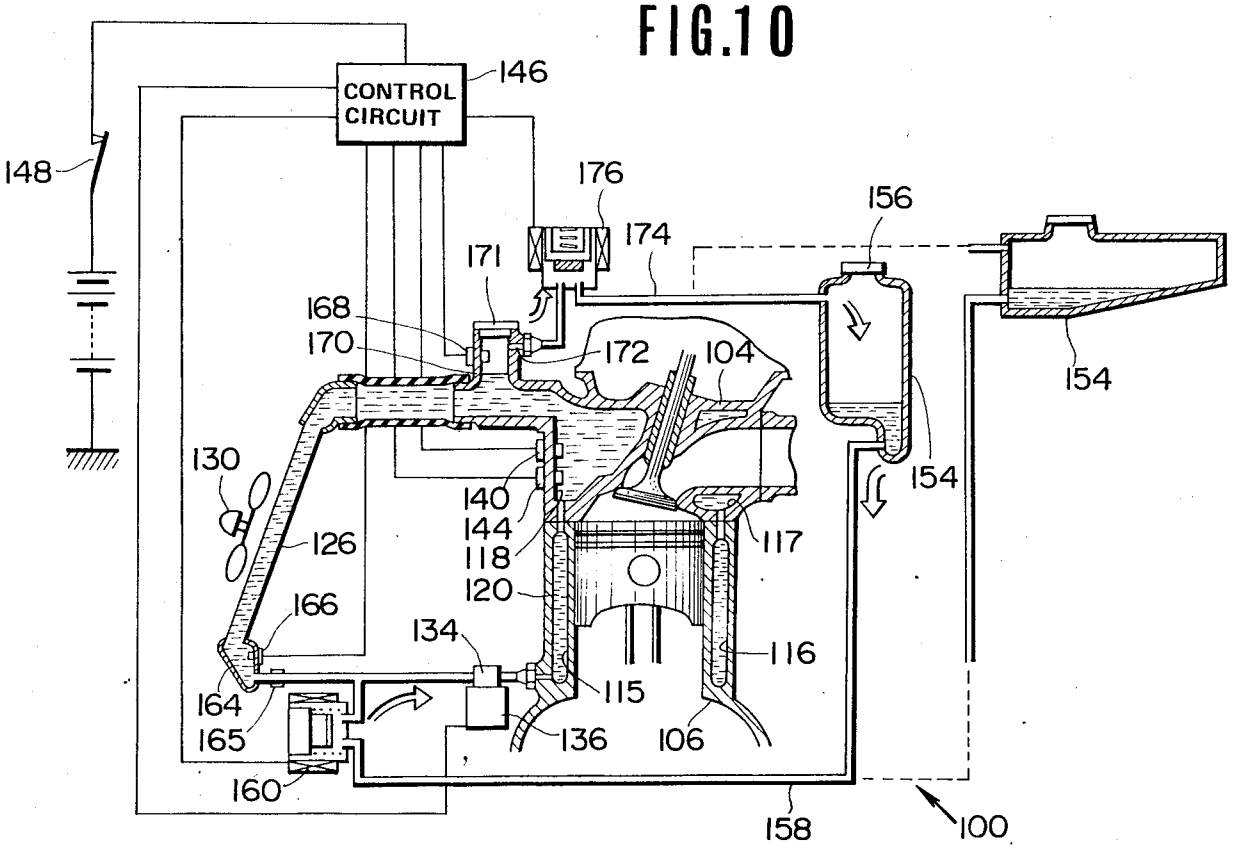
FIGS. 10 and 11 show an engine system incorporating a second embodiment of the present invention.
Figure 11:
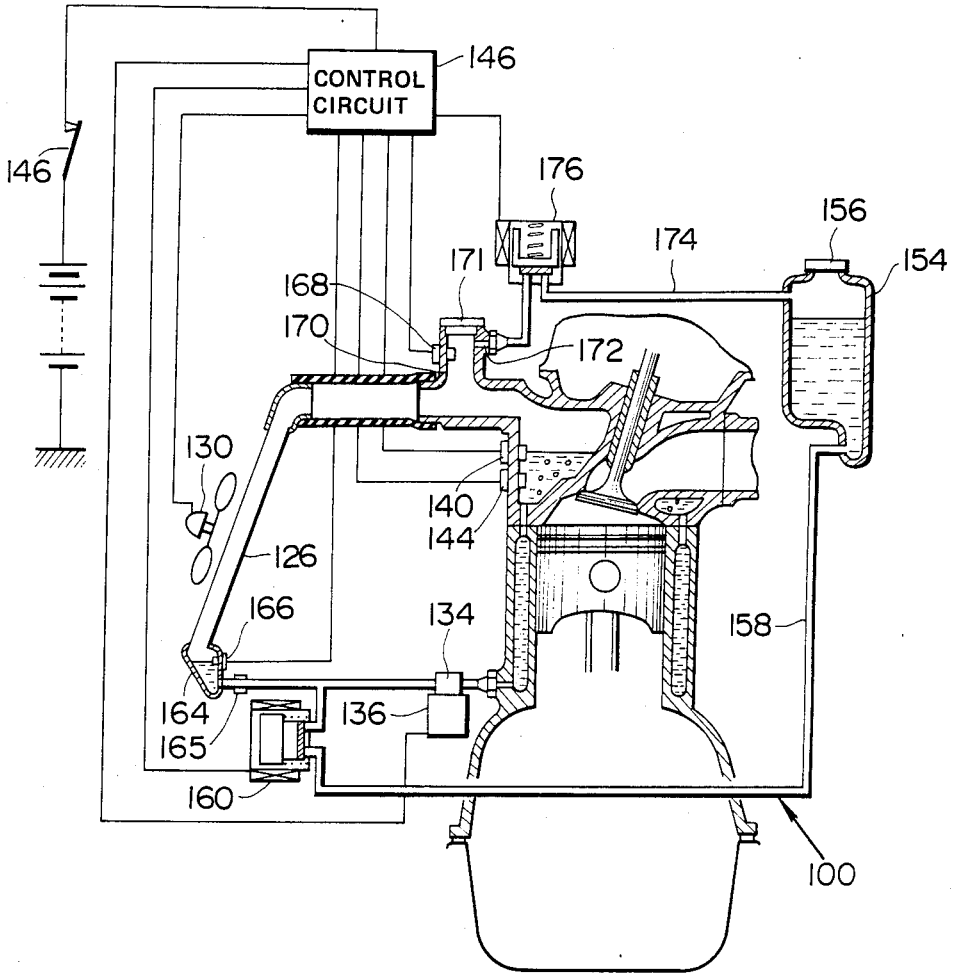

FIGS. 10 and 11 shows a second embodiment of the present invention. This arrangement is essentially similar to the first one and differs basically only on that temperature rather than pressure is used a parameter for controlling the partial filling of the radiator when the engine is subject to "overcool". FIG. 10 shows the second embodiment operating under the previously disclosed "purge mode" wherein excess coolant is pumped from the reservoir 154 in a manner to flush out any non-condensible matter. FIG. 11 shows the system in its normal "closed" operational condition.

It will be noted that the reservoir may be arranged as shown in FIG. 10 to be located above the engine in a manner that gravity assists the filling of the system upon stoppage of the engine. This arrangement also renders it possible to simply open both valves 160 and 176 and allow gravity alone to displace the non-condensible matter. Initial filling of the engine cooling system is facilitated by this arrangement.

It will be noted that in both the first and second embodiments, the provision of the flow restriction 165 tends to direct the flow of coolant from the reservoir 154 primarily into the coolant jacket of the engine. This facilitates quick fill up of the system upon engine shutdown, while smoothing the partial fill of the radiator during engine "overcool".

A further feature common to the first and second embodiments comes in the use of only one conduit and electromagnetic valve to control the charging and discharging of liquid coolant into the cooling system according to the present invention. This reduces the complexity and cost of the system.

Figure 12:
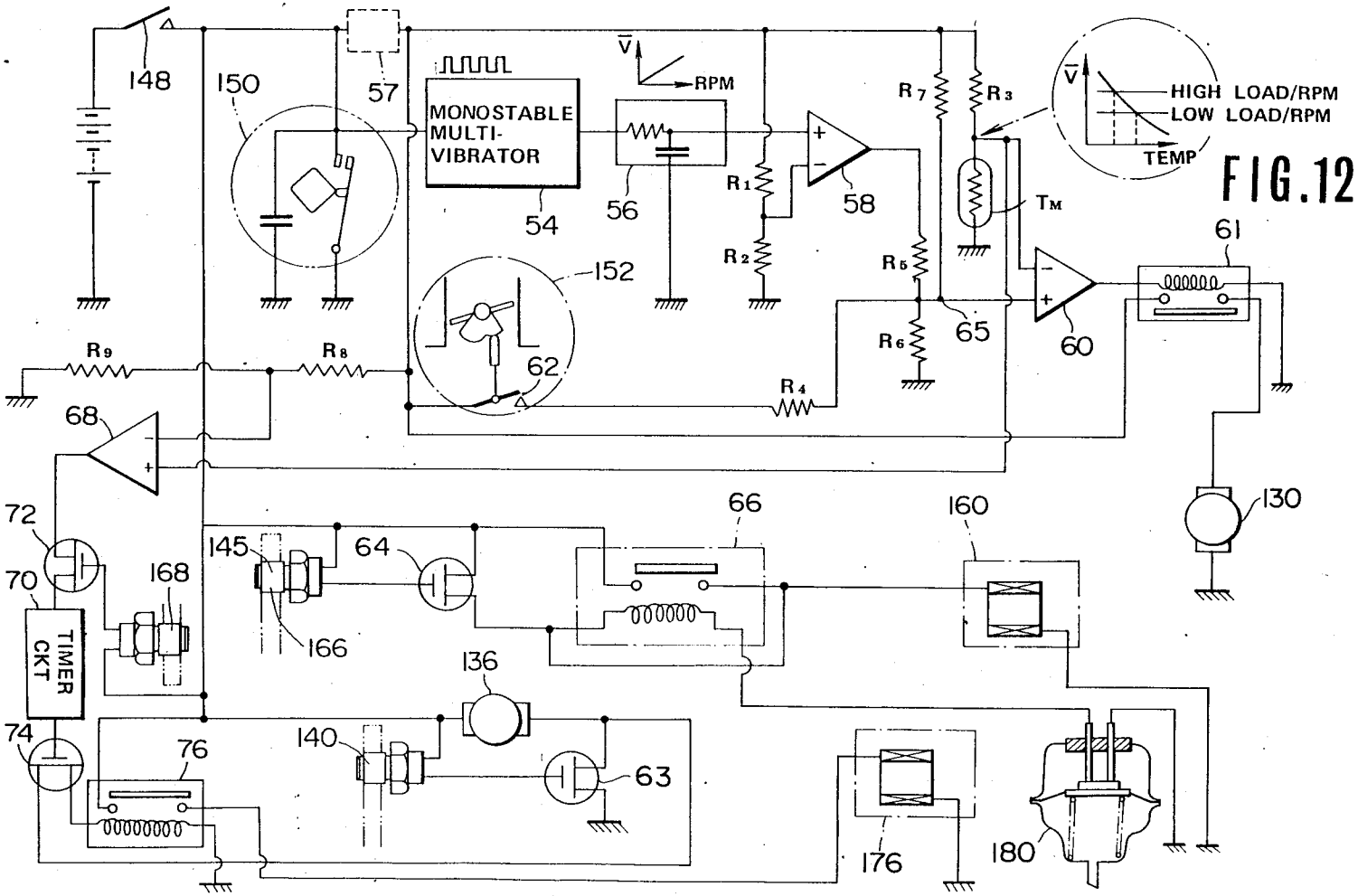
FIGS. 12 and 13 show circuit arrangements suitable for controlling the operation of the first and second embodiments of the invention, respectively.

FIG. 12 shows a circuit suitable for controlling the valves 160, 176, pump 134 and fan 130 of the first embodiment.

In this circuit arrangement the distributor 150 of the engine ignition system is connected with the source of EMF via the switch 148. A monostable multivibrator 54 is connected in series between the distributor 150 and a smoothing circuit 56. A DC-DC converter 57 is arranged, as shown in broken line, to ensure a supply of constant voltage. A first voltage divider consisting of resistors R1 and R2 provides a comparator 58 with a reference voltage at its inverting input (−) thereof while the non-inverting inpug (+) of said comparator receives the output of the smoothing circuit 56. A second voltage dividing arrangement consisting of a resistor R3 and a thermistor $T_M$ (viz., the heart of the temperature sensor 144) applies a variable voltage to a second comparator 60 which also receives a signal from a cam operated throttle switch 62 via a resistor arrangement including resistors R4, R5, R6 and R7 connected as shown. The output of the comparator 60 is applied to the fan 130 via a relay 61 for energizing same.

The circuit further includes a transistor 63 which acts a switch upon receiving an output from the level sensor 140 to establish a circuit between the source of EMF and ground. As a safety measure, an inverter or the like (not shown) may be interposed between the level sensor 140 and the transistor 63, and the level sensor adapted to produce an output when immersed in coolant. With this arrangement should the level sensor malfunction, the lack of output therefrom causes the transistor 63 to be continuously rendered conductive and the pump motor 136 continually energized to ensure that an adequate amount of coolant is maintained in the coolant jacket.

In order to acheive the desired control of valve 160, level sensor 166 is circuited via transistor 64 with a self-energizing relay 66 in a manner that, until the level of the coolant in the radiator 126 is forced down to the level of the level sensor 166, the relay is not closed and the solenoid of the valve 160 not energized, whereby the desired amount of coolant contained in the radiator 126 and coolant jacket can be appropriately adjusted. Opening of the switch 148 de-energizes the solenoid of the valve 160 and opens the self energizing relay 66.

As will be appreciated, with the circuit thus far disclosed, depending on the load and engine speed, the temperature of the coolant in the coolant jacket 120 will be adjusted in a manner that a low engine speeds and loads the voltage appearing at the inverting terminal of the comparator will be compared with the voltage appearing on the non-inverting terminal thereof and the fan 130 suitably engergized to maintain a high temperature under so called "urban cruising" conditions and lowered at high load/speed operation. Further, upon stoppage of the motor, the coolant jacket 120 and radiator 126 will be completely filled with coolant to exclude the possiblity of air contamination.

This circiut further includes a comparator 68 which receives the output of second voltage divider (R3, $T_M$) on its non-inverting terminal (+) and a reference voltage from a voltage divider consisting of resistors R8, R9 on its inverting one (−). The resistances of the resistors R8, R9 are selected to provide a voltage representative of the predetermined temperature (viz., 35° C.).

The output of this comparator 68 is fed to a timer circuit 70 via transistor 72. The base of this transistor 72 is connected with the third level sensor 168 so that upon the level falling below same, the sensor 168 outputs a signal rendering the transistor 72 conductive. The timer circuit 70 may be arranged to maintain a high level output for a short period of time after the high level ouput of the comparator 68 disappears (3–4 seconds for example). The output of the timer circuit 70 is fed to the base of a transistor 74 which as shown, serves a switch for energizing relay 76. This relay 76 upon being closed by a current passing through the coil thereof (via the pump motor 136 and the transistor 74), supplies current to the solenoid of valve 176.

As will be appreciated if the temperature of the coolant as sensed by the termister Tm is below 35° C. and the level of coolant is below the third level sensor 168, then valves 160, 162 and 168 and the pump motor 136 will be energized.

If desired the timer circiut 70 may be omitted.

The pressure responsive switch 180 is circuited with the coil of the self-energizing relay 66 so that when closed the coil is grounded. However, upon opening of the switch, the potential difference across the coil disappears and the relay opens 66. This permits the coolant to enter and partially fill the radiator 126 as previously described. Subsequently, when the switch 180 closes and the transistor 64 subsequently rendered conductive by an output from the level sensor 166, the self-energizing relay 66 is again closed.

Figure 13:
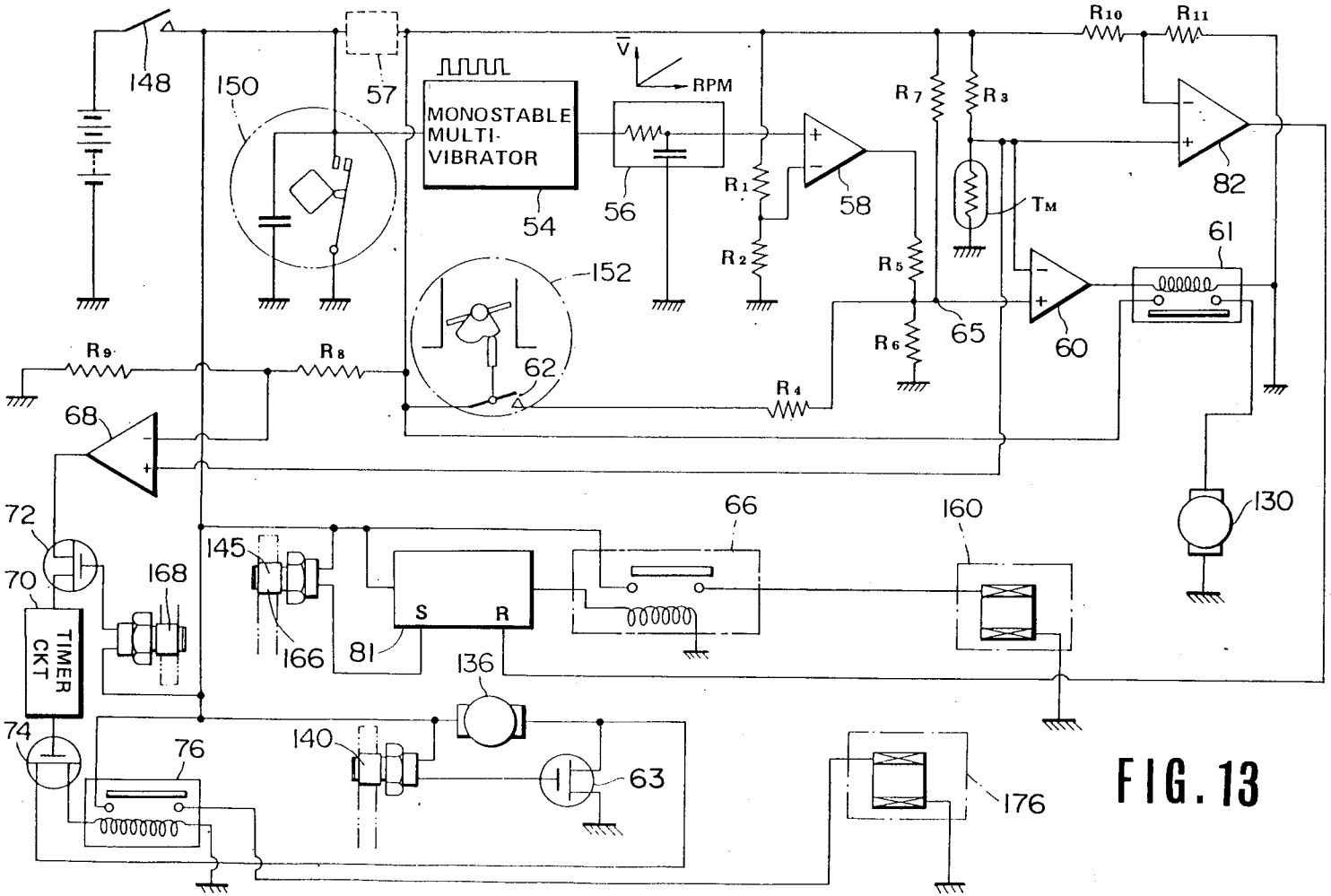

FIG. 13 shows a circuit arrangement wherein the pressure responsive switch 180 is replaced with a circuit responsive to temperature. In this circuit transistor 64 is replaced with a dual stable multivibrator 81. The set terminal (S) of this device is connected to the output of the level sensor 166 in a manner to be triggered to output a high level signal when the level sensor outputs a signal indicative of the coolant level having fallen thereto. The reset terminal (R) of multivibrator 81 is connected to a comparator 82. The comparator 82, as shown, is arranged to receive on its inverting input, a fixed voltage from a voltage divider comprised of resistors $R_{10}$, $R_{11}$. The non-inverting terminal of the comparator 82 is arranged to receive a variable voltage signal indicative of the coolant temperature. The resistors $R_{10}$, $R_{11}$ are chosen so that upon the temperature of the coolant having fallen to a undesirably low level (corresponding the pressure level at which the pressure responsive switch is triggered) the comparator 80 outputs a high level signal to the reset terminal (R) of multivibrator 81. This switches the output of the multivibrator 81 to a low level whereat the thus self-energizing relay 66 is permitted to open, and thus opens valve 160.

The operation of this circuit is essentially the same as that of the previously described one, and further disclosure in connection therewith will be omitted for brevity.

Figure 14:
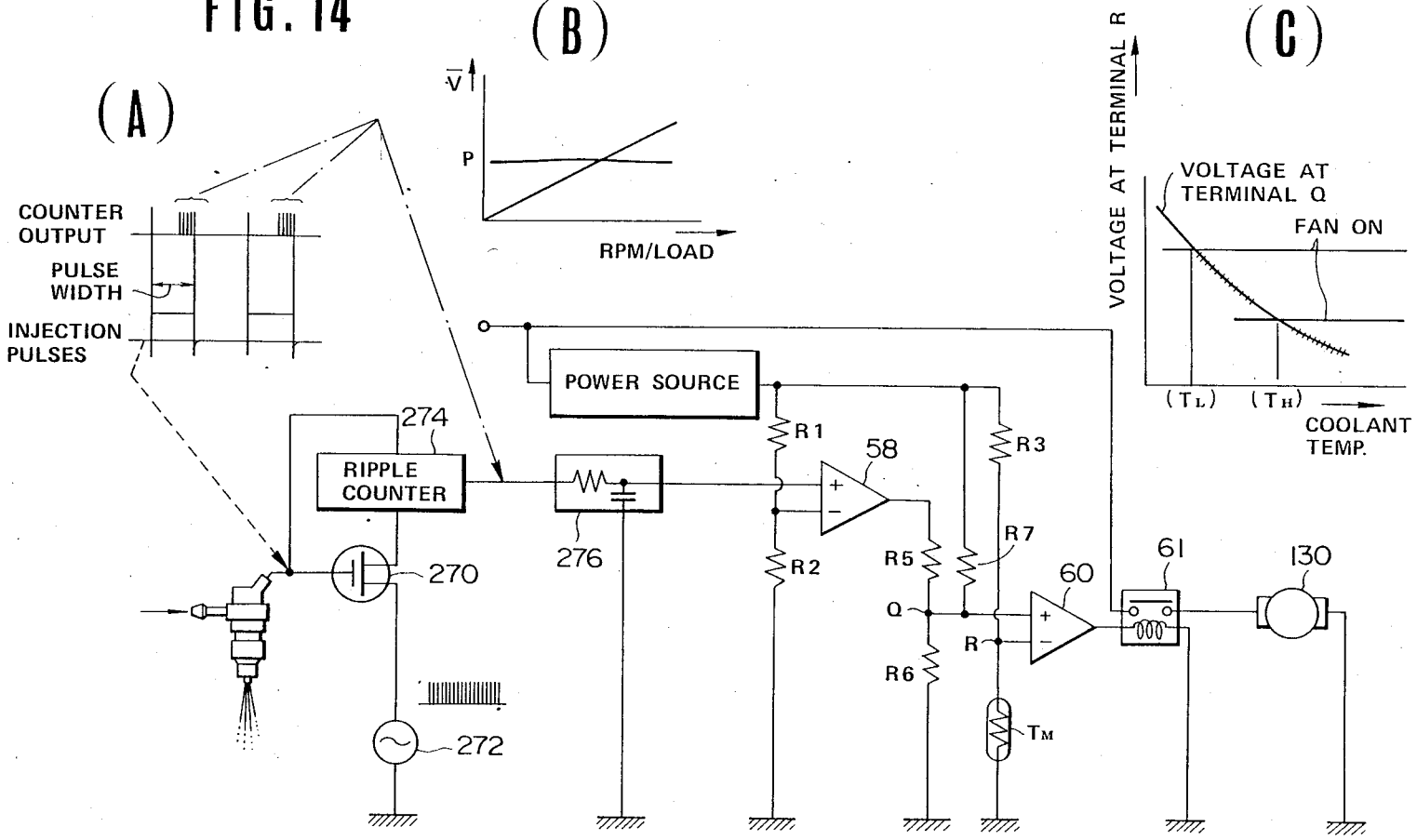
FIG. 14 shows a circuit arrangement suitable for use in fuel injected engines.

FIG. 14 shows a third circuit arrangement which may be employed in the case the engine is equipped with a fuel injection system.

This alternative arrangement differs from that shown in FIG. 7 by the inclusion of a transistor 270, a clock circuit 272, a ripple counter 274 and a smoothing circuit 276, all connected as shown. Due to the fact that the frequency of injection control pulses varies with engine speed and the voltage output of the smoothing circuit 276 varies with pulse width as well as the frequency of injection, it is possible to use this arrangement in place of both of the throttle switch 62 and distributor 150 as will be appreciated by those skilled in the art. For the sake of simplicity the level sensors 140, 166 and 168 and associated circuitry have been omitted from this figure.

More specifically, the operation of the FIG. 7 circuit is such that when the injector driving signal is applied to the base of the transistor 270 and the output of the clock generator 272 is fed to the ripple counter 274. The characteristics of the ripple counter 274 are so selected that it outputs a carry only when the width of the injection pulses are greater than a predetermined value (viz., indicative of a load in excess of a predetermined value). The injection driving pulses are applied to the reset terminal of the counter 274. Upon the width of the injection pulse exceeding said predetermined value, the ripple counter 274 will output a carry (a number of clock pulses) which varies with the width of the pulse in excess of the predetermined value, as will be clear from insert "A". The output of the smoothing circuit 276 accordingly increases with engine speed and load (pulse width). The output of the smoothing circuit 276 is applied to the non-inverting terminal (+) of the comparator 58 which receives a fixed reference voltage from the voltage divider defined by resistors R1 and R2 on its inverting one (−). Accordingly, upon the voltage level of the smoothing circuit 276 output exceeding that provided by the R1 - R2 voltage divider (see voltage P in insert "B"), the comparator produces an output to terminal Q.

The voltage appearing at terminal R decreases with increase of coolant temperature due to the inherent characteristics of the thermistor $T_M$. Accordingly, if the voltage appearing on terminal R is at a high level due to the engine operating at high load/speed conditions, the fan 130 will be energized to maintain a low coolant temperature ($T_L$) as will be clear from insert "C". On the other hand, should the engine be operating under the so called "urban cruising" conditions, the voltage appearing on terminal Q will be low due to absence of an output from the comparator 58 and the fan 130 will be operated in a manner to reduce the rate of condensation in the radiator 126 and raise the temperature of the coolant to a high level ($T_H$).

A microprocessor may be used in place of the above disclosed circuits. This processor of course may also be used for other engine control functions as well known in the art of engine control. The program via which the embodiment shown in FIG. 11 can be controlled is deemed relatively simple and well within the perview of one skilled in the art of computer programming and thus will not be discussed for brevity.

It will be noted that, if deemed advantageous, the temperature of the engine coolant may be varied continuously with change in load and/or engine speed as different form the stepwise control disclosed hereinbefore. This may be achieved by omitting comparators 58 and replacing the cam operated switches 62 with variable resistors so that the voltage appearing on the non-inverting inputs of comparators 60 will gradually vary with load and engine speed.

What is claimed is:

1. In a method of cooling a device, the steps of:

boiling a liquid coolant in a coolant jacket to produce a vapor;

condensing the vapor produced in said boiling step, in a radiator;

increasing the boiling point of said liquid coolant by reducing the heat exchange capacity of said radiator in the event that the rate of condensation exceeds a predetermined maximum value and the boiling point of said liquid coolant falls below a predetermined minimum value, wherein said coolant jacket and said radiator form part of a cooling system, and including the step of selectively sealing the cooling system to selectively permit pressure in said system to vary above or below atmospheric.

2. A method as claimed in claim 1, wherein said step of reducing includes partially filling said radiator with liquid coolant.

3. An internal combustion engine as claimed in claim 2, wherein said first parameter sensing sensor senses engine load.

4. An internal combustion engine as claimed in claim 3, wherein said device induces a first rate of condensation in said radiator which maintains the temperature of said coolant in said coolant jacket below a predetermined temperature when said first sensor indicates the load on said engine is above a predetermined level and which induces a second rate of condensation which maintains the temperature of said coolant in said coolant jacket above said predetermined temperature when said first sensor indicates the load on said engine is below said predetermined level.

5. An internal combustion engine as claimed in claim 4, further comprising a third parameter sensor which senses the rotational speed of said engine.

6. In an internal combustion engine having a combustion chamber;

a radiator;

a coolant jacket in which liquid coolant is boiled and the vapor produced conveyed to said radiator for condensation therein;

a first parameter sensor for sensing a first engine operation parameter;

a device responsive to said first sensor for varying the rate of condensation of said vapor in said radiator;

a pressure differential sensor for determining a difference in pressure between pressure in said radiator and atmospheric pressure; and means responsive to said pressure differential sensor for introducing liquid coolant into said radiator in a manner to partially fill same and reduce the heat exchange capacity of said radiator in the event that the determined pressure difference reaches a level indicating that the rate of condensation in said radiator is above a predetermined maximum value and the boiling point of said liquid coolant is below a predetermined minimum value.

7. An internal combustion engine as claimed in claim 6, wherein said radiator and coolant jacket form a cooling system, and including means for sealing said cooling system such that pressure in said cooling system may be above or below atmospheric.

8. In an internal combustion engine having a combustion chamber;

a radiator;

a coolant jacket in which liquid coolant is boiled and the vapor produced conveyed to said radiator for condensation therein;

a first parameter sensor for sensing a first engine operation parameter;

a device responsive to said first sensor for varying the rate of condensation of said vapor in said radiator;

an arrangement for reducing the heat exchange capacity of the said radiator in the event that the rate of condensation therein increases above a predetermined maximum value;

a first level sensor disposed in said coolant jacket at a level higher than said combustion chamber; and a pump responsive to said first level sensor for returning condensed coolant from said radiator to said coolant jacket in a manner which maintains the level of liquid coolant in said coolant jacket at the level of said first level sensor, said pump being disposed in a return conduit which leads from said radiator to said coolant jacket.

9. An internal combustion engine as claimed in claim 8, further comprising a second parameter sensor disposed in said coolant jacket for sensing a parameter which varies with one of the temperature and pressure prevailing in said coolant jacket.

10. An internal combustion engine as claimed in claim 8, further comprising:

a reservoir containing liquid coolant;

a supply conduit leading from said reservoir to said return conduit, said supply conduit merging with said return conduit at a location intermediate of said pump and said radiator;

a first valve for controlling fluid communication between said supply conduit and said return conduit; and a flow restriction disposed in said return conduit at a location intermediate of said radiator and said supply conduit;

said heat exchange capacity reducing arrangement being arranged to open said first valve to permit liquid coolant from said reservoir to partially fill said radiator.

11. An internal combustion engine as claimed in claim 10, further comprising a control arrangement which opens said first valve when said engine is stopped.

12. An internal combustion engine as claimed in claim 11, further comprising: a second level sensor disposed at the bottom of said radiator, said control arrangement being responsive to the starting of said engine and to the output of said second level sensor for closing said first valve.

13. An internal combustion engine as claimed in claim 12, further comprising:

a third level sensor disposed in one of said coolant jacket and said radiator and located at a level whereat it is immersed in liquid coolant only when said coolant jacket and said radiator are completely filled with liquid coolant; and a second valve which controls fluid communication between said reservoir and one of said coolant jacket and radiator, said second valve being disposed in an overflow conduit which leads from a location in close proximity of said third level sensor to said reservoir;

said control arrangement being arranged to open and close said first, and second valves and operate said pump in response to the outputs of said third level sensor and said second sensor in a manner to fill said coolant jacket and radiator with liquid coolant from said reservoir until said third level sensor is immersed therein and thus displace any non-condensible matter out through said overflow conduit and said second valve to said reservoir, when the temperature within said coolant jacket is at a level at which said radiator and coolant jacket should be completely filled with liquid coolant.

14. In a method of cooling a device, the steps of:

boiling a liquid coolant in a coolant jacket to produce a vapor;

condensing the vapor produced in said boiling step, in a radiator;

sensing the level of coolant in said coolant jacket;

pumping liquid coolant from said radiator to said coolant jacket in response to said level sensing step;

sensing a difference in pressure between pressure in said radiator and atmospheric pressure; and reducing the heat exchange capacity of said radiator in the event that the sensed difference in pressure indicates that the rate of condensation exceeds a predetermined maximum value.

15. In a method of cooling a device, the steps of:

boiling a liquid coolant in a coolant jacket to produce a vapor;

condensing the vapor produced in said boiling step, in a radiator, and increasing the amount of liquid coolant in said radiator above a predetermined value in the event that the rate of condensation in said radiator exceeds a predetermined maximum value and the boiling point of the coolant in said coolant jacket falls below a predetermined minimum value.

16. A method as claimed in claim 15, further comprising:

sensing an operation parameter of said device; and controlling the rate of condensation in said radiator in accordance with the magnitude of said sensed parameter.

17. A method as claimed in claim 15, further comprising the step of:

filling said coolant jacket and radiator with liquid coolant when the engine is stopped.

18. A method as claimed in claim 15, further comprising the step of:

introducing excess liquid coolant into said coolant jacket and radiator to flush out any non-condensible matter which has found its way into said coolant jacket and radiator.

19. In a method of cooling a device, the steps of:

boiling a liquid coolant in a coolant jacket to produce a vapor;

condensing the vapor produced in said boiling step in a radiator;

sensing a pressure differential between pressure in said radiator and the ambient atmospheric pressure;

increasing the volume of liquid coolant in said radiator in the event that the pressure differential indicates that the rate of condensation in said radiator is exceeding a predetermined maximum value.

* * * * *

UNITED STATES PATENT AND TRADEMARK OFFICE

CERTIFICATE OF CORRECTION

PATENT NO. : 4,677,942

DATED : July 7, 1987

INVENTOR(S) : Yoshimasa Hayashi

It is certified that error appears in the above-identified patent and that said Letters Patent is hereby corrected as shown below:

Title page Item 21, change "687,780" to --637,780--.

Signed and Sealed this

Second Day of February, 1988

*Attest:*

DONALD J. QUIGG

*Attesting Officer*

*Commissioner of Patents and Trademarks*